United States Patent [19]

Hanson et al.

[11] 4,383,542

[45] May 17, 1983

[54] CLEANING MACHINE

[75] Inventors: Wayne H. Hanson, Minnesota City; Derrick L. Heyl, Rolling Stone, both of Minn.; Bradley D. Krause, Cochrane, Wis.; Richard C. Kravik, Minnesota City, Minn.; Gerald P. Lawson; Jerry L. Schueler, both of Winona, Minn.

[73] Assignee: Winona Tool Manufacturing Company, Winona, Minn.

[21] Appl. No.: 263,874

[22] Filed: May 15, 1981

[51] Int. Cl.[3] ..... B08B 3/10

[52] U.S. Cl. ..... 134/105

[58] Field of Search ..... 134/105, 107, 108

[56] References Cited

U.S. PATENT DOCUMENTS 2,825,349 3/1958 Keliher et al. ..... 134/105

3,182,669 5/1965 Campbell et al. ..... 134/105

FOREIGN PATENT DOCUMENTS 223757 12/1942 Switzerland ..... 134/107

*Primary Examiner*—Robert L. Bleutge

*Attorney, Agent, or Firm*—Kinzer, Plyer, Dorn & McEachran

[57] ABSTRACT

This is a cleaning machine for cleaning or washing parts, such as automobile parts and the like, which includes a cabinet having a liquid spray structure therein constructed and arranged to spray a cleaning solution on the parts. It is more specifically concerned with a heating arrangement for heating the solution, which is contained and collected in the sump of such a machine.

2 Claims, 3 Drawing Figures

CLEANING MACHINE

SUMMARY OF THE INVENTION

This invention is concerned with a cleaning machine of the type which has a generally upright cabinet with a sump in the bottom thereof for holding a certain quantity of a cleaning fluid which may be a caustic solution. Such a machine is used for cleaning the parts, for example, of automobile engines as they are being made and might more broadly be looked at as usable for cleaning articles such as metal castings, forgings, stampings, engine parts, etc., although it is not limited thereto.

A primary object of the invention is a heating arrangement for maintaining the cleaning solution for such a unit at a more uniform temperature.

Another object is a cleaning unit of the above type in which cycling of the heating unit is simplified.

Another object is a cleaning unit of the above type which is specifically concerned with an improved hot air or hot gas heating unit.

Another object is a heating arrangement for a cleaning unit of the above type which is constructed and arranged to maintain the cleaning fluid in the sump at a more uniform temperature from top to bottom.

Another object is an improved heating unit which has better heat transfer aspects to it.

Another object is a heating unit for a cleaning machine of the above type which avoids foaming or boiling over problems of the cleaning liquid.

Another object is a heating unit for a cleaning machine of the above type which avoids the problems that go with an automatically timed cycling arrangement.

Another object is a heating unit of the above type which avoids or prevents thermal layering.

Other objects will appear from time to time in the ensuing specification and drawings.

DESCRIPTION OF THE PREFERRED EMBODIMENTS

Figure 1:
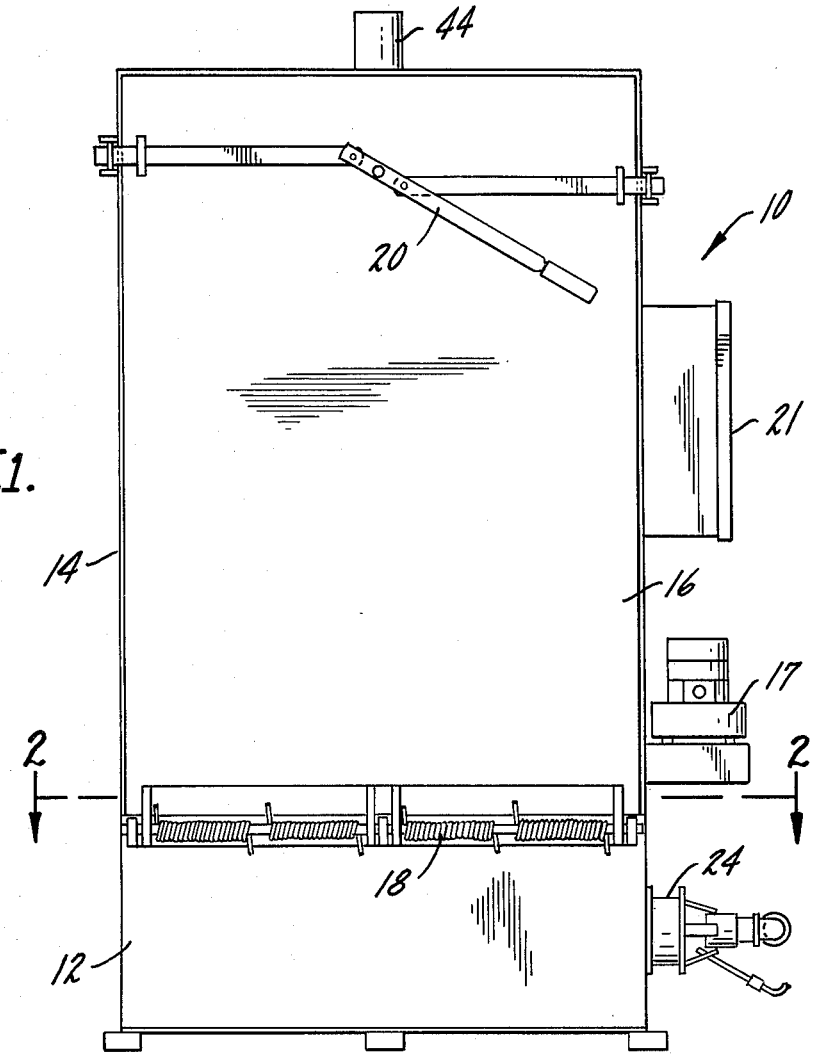
FIG. 1 is a front view of the machine.

In FIG. 1 a generally upright cabinet is indicated at 10 with a sump 12 in the base or bottom and a container or cabinet at 14 on top. The cabinet has a door 16 which is pivoted generally at 18 with a conventional latching arrangement 20 at any suitable point. The door 16 opens down but it might be pivoted along the side, either one side or the other, or a multiple door configuration may be used. The door 16 closes a generally open chamber where parts to be cleaned may be placed, such as parts for automobile engines and the like. A suitable piping system with jets or nozzles may be arranged inside of the cabinet so that a cleaning solution may be sprayed on the parts from various angles. When the door 16 is open a tray or table inside of the cabinet may be brought out, either by a pivoting arrangement or on rollers or otherwise. The tray or basket supports the parts which are to be cleaned and may be rotated by a motor 17. Cleaned parts can be removed and new or dirty ones put on the tray, then it is swung or moved back into the cabinet and the door is closed. All of this may be conventional and has not been illustrated. The cabinet may have a suitable control panel 21.

The solution that is sprayed on the parts to clean them is generally considered a water soluble degreasing compound. After the solution is sprayed on the parts it falls into the sump 12 where it is heated, and recycled up through the piping system and again sprayed on the parts in a closed loop or closed circuit arrangement. The solution may be circulated by a pump 23, in FIG. 2, which draws from the bottom of the sump.

The sump 12 in the bottom of the container or housing is a collecting point for the cleaning solution which may be something on the order of, say, 18" deep. It is desirable for control purposes to have the temperature of the solution in the sump generally uniform throughout rather than having the solution on top at a substantially higher temperature, say 190°, than the fluid on the bottom, say 120°. Cycling of the machine becomes difficult and erratic if the temperature of the solution varies this much from top to bottom and it is desirable to have the temperature of the solution generally uniform throughout or as close as you can get it.

Figure 2:
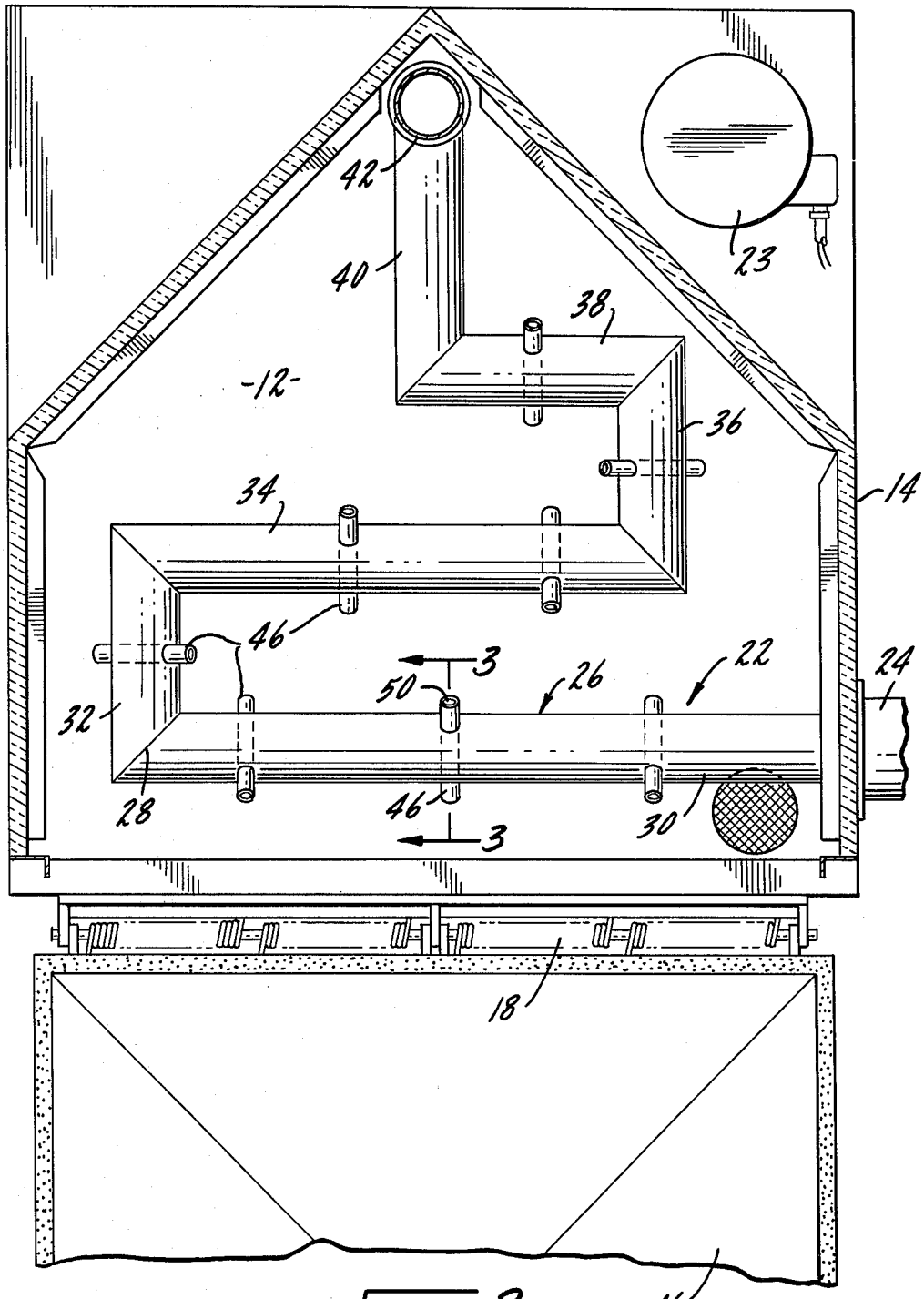
FIG. 2 is a section along line 2—2 of FIG. 1, on an enlarged scale, and with the door open.

In FIG. 2 a heat exchange unit 22 is shown positioned in the bottom of the sump and is supplied with a hot gas from a burner 24 in the side wall of the sump. The heat exchanger is in the form of a plurality of generally rectilinear round tubes 26 which are interconnected at mitered joints 28 which, in the particular form shown, take on the character of 45° miters which have been butted together and welded. The particular heat exchanger illustrated has a main inlet unit 30, a mitered cross piece 32, a return piece 34, a second return miter 36, a third main piece 38 with a discharge 40 running to a riser 42 which may go through the top of the cabinet to an exhaust outlet 44 in FIG. 1.

Transfer ducts 46 in the form of short tubes extend through the main pipes, are open at each end and extend beyond the outer surface of the main pipes a short distance. It will be noted that three such transfer ducts are shown in the main tube 30 and are positioned at generally uniform intervals but it might be otherwise. The same is true of the other ducts. The particular number and spacing however is not considered critical.

Each of the transfer ducts 46 is substantially smaller in cross section, say, less than one half, so that is does not block or excessively restrict the flow of hot gases through the main pipes. But at the same time the cross transfer ducts tend to break up any smooth or laminar flow of the hot gases and induce turbulence to break down any boundary layer effect between the inner surface of the main ducts and the hot gases so that more of the hot gas will be brought into contact with the tube wall. It will also be noted that the cross transfer tubes are disposed at what may be considered to be generally a 45° angle, either to the horizontal or vertical, and that the angular disposition is alternated from one cross transfer tube to another so that the traveling gases are required to reorient left and right which further reduced any tendency of a boundry layer effect to take place between the flowing hot gas and the inner wall of the tube.

Figure 3:
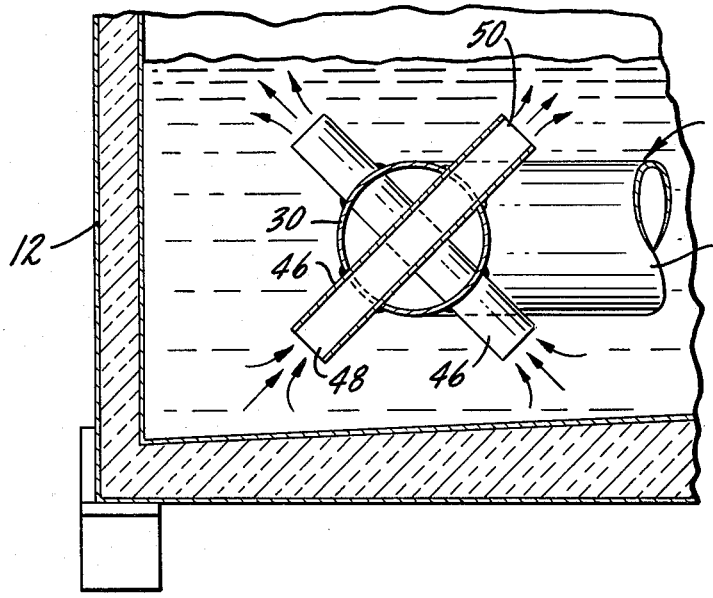
FIG. 3 is a section along line 3—3 of FIG. 2.

As will be noted in FIG. 3 the heat exchanger element 22 is totally submerged in the solution in the sump. This is to say that the cross transfer tubes 46 are below the surface of the fluid. Thus the lower end 48 of each of the tubes will provide an inlet for the cooler solution while the upper end 50 will function as an outlet for the warmer solution. Thus the cross transfer tubes serve a convection function to bring the solution from the bottom of the sump, which tends to be cooler, up to the top, which tends to be warmer, thereby inducing a natural circulation between top and bottom thereby making the temperature throughout the solution more uniform. This is to say that the temperatures in the top and bottom of the solution will not vary drastically from each other. This will greatly decrease control problems involved with turning the hot gases off and on from time to time. It will also enable the solution to heat up more rapidly during startup. And in those situations where the solution is taken from the bottom of the sump for the spray jets and so forth, the solution will be closer to or the same temperature as the solution on top of the sump. Also, the location of the thermostat is not that critical anymore.

It will be understood that any suitable gas or oil burner may be used and may have a pilot light arrangement, etc., so the details have not been shown. The same is true of the thermostat which has not been shown but may be any suitable type installed in such a manner and at any suitable location to control the cycling of the burner. It is preferred that the thermostat be located generally in the same plane as the heat exchanger but it may be otherwise.

Whereas straight tubing with mitered corners has been shown, it should be understood that under certain circumstances this tubing may be continuous and bends may be used at each of the corners. Also, the cross section of the tubing has been shown as round but it could be square, rectangular or what have you. The spacing of the cross transfer tubes 46 should be so as not to excessively restrict the hot gas flow, which is related to the draw on the stack or discharge.

While the preferred form and several variations of the invention have been shown and suggested, it should be understood that suitable additional modifications, changes, substitutions and alterations may be made without departing from the invention's fundamental theme. I have shown the cross transfer tubes or ducts as extending a certain distance below and above the main heat transfer tubes, but it should be understood that under certain circumstances they may be more or less and in certain installations they might not project at all. But an inch or two of projection for heat transfer purposes is considered more desirable.

The embodiments of the invention in which an exclusive property or privilege is claimed are defined as follows:

1. In a parts cleaning machine, a generally upright cabinet with a sump in the bottom for a cleaning solution, a door in the wall of the cabinet providing access to the interior thereof, a soure of hot gas connected to the cabinet and communicating with the sump, a heat exchanger in the sump connected to the hot gas source, the heat exchanger including an irregular tube passage in the sump connected to a flue discharge that extends outside of the cabinet, and a plurality of transfer ducts at spaced intervals extending through the tube passage, smaller in cross section than the tube passage, to provide for fluid flow in a generally vertical direction through the tube passage disposed generally at right angles to the direction of hot gas flow to provide for heat transfer at the same time that the fluid is receiving heat from the outside of the tube passage, the transfer ducts being in the form of pipes which extend through the tube passage and project somewhat on each side thereof, each of the pipes being inclined at about a 45° angle to the vertical with the angle of inclination alternating from one pipe to another.

2. The structure of claim 1 in which the transfer ducts are in the form of round tubes.

* * * * *